United States Patent [19]

Elliot

[11] 4,305,572

[45] Dec. 15, 1981

[54] RETURN ASSEMBLY FOR A SWIVABLE SHEAVE

[75] Inventor: Jeremy F. Elliot, Delaware, Ohio

[73] Assignee: Dresser Industries, Inc., Dallas, Tex.

[21] Appl. No.: 107,755

[22] Filed: Dec. 27, 1979

[51] Int. Cl.[3] ..... B66D 3/04

[52] U.S. Cl. ..... 254/414; 254/393; 254/415

[58] Field of Search ..... 254/414, 415, 413, 393, 254/394; 212/171; 37/116; 267/25, 26, 57, 150, 154, 155; 74/470

[56] References Cited

U.S. PATENT DOCUMENTS

| | | | |
|---|---|---|---|
| 21,602 | 9/1858 | Focht | 254/415 |
| 998,385 | 7/1911 | Owen | 254/414 |
| 1,906,665 | 5/1933 | Ticknor | 254/414 |
| 3,757,959 | 9/1973 | Thompson et al. | 254/393 |
| 4,053,139 | 10/1977 | Lovaas et al. | 254/393 |

*Primary Examiner*—Billy S. Taylor

*Attorney, Agent, or Firm*—Gerald L. Lett

[57] ABSTRACT

In a machine having a boom, a sheave swivably mounted on the boom and a line reeved over and around the sheave, an assembly for returning the sheave to a predetermined position relative to the boom upon the sheave being rotatably displaced about its swivel axis by forces applied by the line, consisting of a righting arm operatively connected to the sheave for rotatable movement therewith about the swivel axis and means operatively engageable with the righting arm for rotatably biasing the righting arm and correspondingly the sheave about the swivel axis toward the predetermined position.

11 Claims, 8 Drawing Figures

RETURN ASSEMBLY FOR A SWIVABLE SHEAVE

This invention relates to a machine having a boom, a sheave swivably mounted on the boom and a line reeved over and around the sheave, and more particularly to an assembly for returning such a sheave to a predetermined rest position relative to the boom upon the boom being rotatably displaced about its swivel axis by forces applied by the line reeved over and around the sheave. This invention further particularly applies to a boom point sheave assembly of a drag line type of excavator.

In the prior art, there has been developed a boom point sheave assembly for a drag line type of excavator in which torsion bars are utilized to cause the boom sheaves to return to predetermined rest positions relative to the boom upon being rotatably displaced by loads applied by the hoist rope loads. Such type of assembly is illustrated and described in U.S. Pat. No. 3,757,959, dated Sept. 11, 1973.

While the type of assembly disclosed in the aforementioned patent has been found to be highly effective and successful in large drag line applications, it further has been found to be comparatively expensive to manufacture and to have a relatively short service life. It thus has been found to be desirable to provide a sheave assembly of the type described having an improved means for biasing the sheave to the desired rest position which is more economical to manufacture and which will provide a longer service life.

Accordingly, it is the principal object of the present invention to provide an improved sheave assembly.

Another object of the present invention is to provide an improved means in a sheave assembly for returning a swivably mounted sheave thereof to a predetermined rest position.

A further object of the present invention is to provide in a machine having a boom, a sheave swivably mounted on the boom and a line reeved over and around the sheave, an improved assembly for returning the sheave to a predetermined position relative to the boom upon the sheave being rotatably displaced about its swivel axis.

A still further object of the present invention is to provide in a machine having a boom, a sheave swivably mounted on the boom and a line reeved over and around the sheave, an assembly for returning the sheave in a predetermined position relative to the boom upon the sheave being rotatably displaced about its swivel axis by forces applied by the line, which is simple in design, comparatively inexpensive to manufacture and effective and reliable in performance, and which also has a longer service life than comparable assemblies in the prior art.

Another object of the present invention is to provide an improved boom point sheave assembly for excavating machines such as drag lines and the like.

A further object of the present invention is to provide in an excavating machine having a boom, a sheave swivably mounted at the point of the boom, and a hoist rope reeved over and around the boom point sheave, an improved assembly for returning the boom point sheave to a predetermined rest position relative to the boom upon the sheave being rotatably displaced about its swivel axis by lateral loads applied by the hoist rope on the sheave.

Other objects and advantages of the present invention will become more apparent to those persons having ordinary skill in the art to which the present invention pertains from the following description taken in conjunction with the accompanying drawings, wherein.

Figure 1:
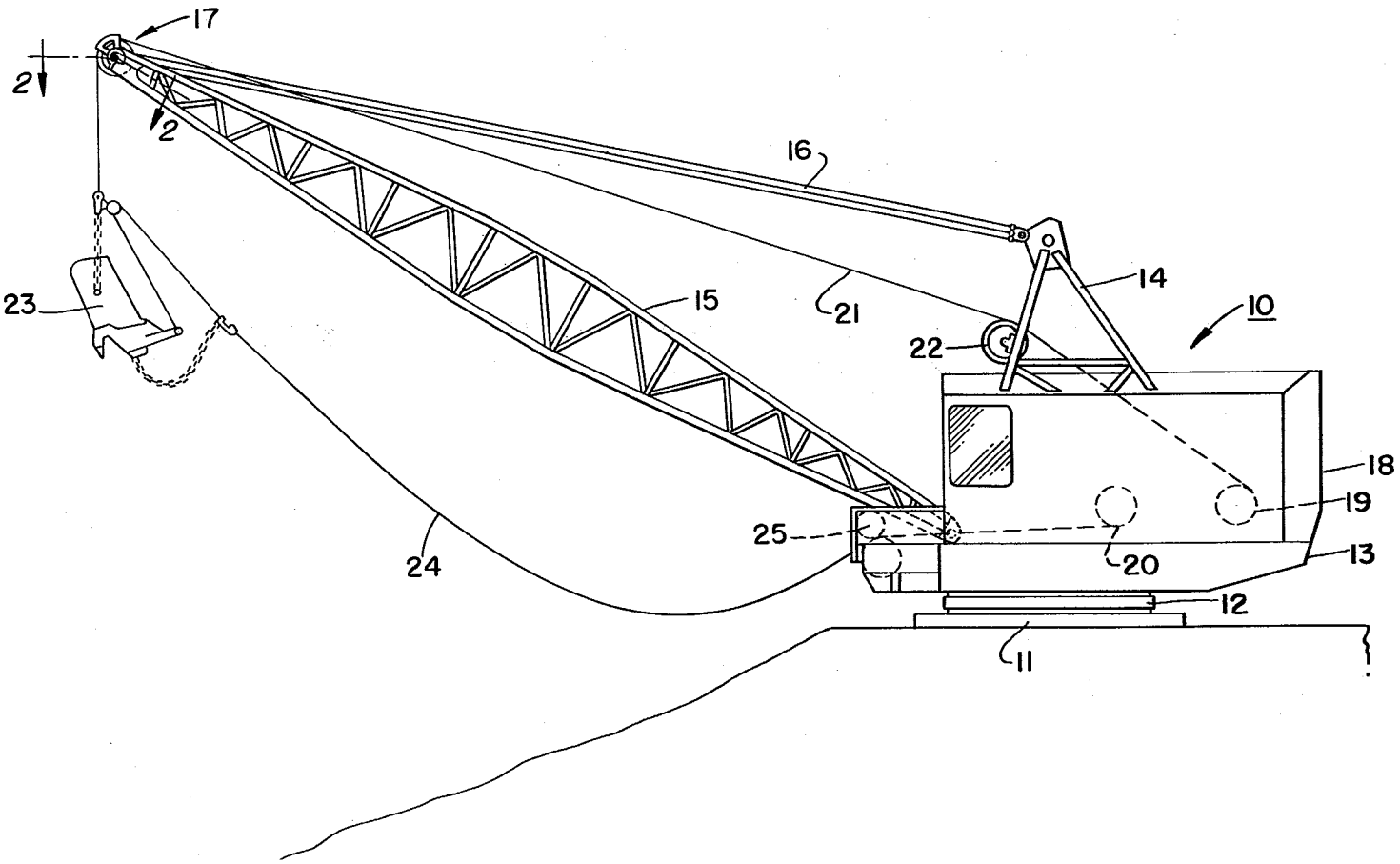
FIG. 1 is a side elevational view of a drag line type of excavator in which there is incorporated an embodiment of the present invention.
Figure 2:
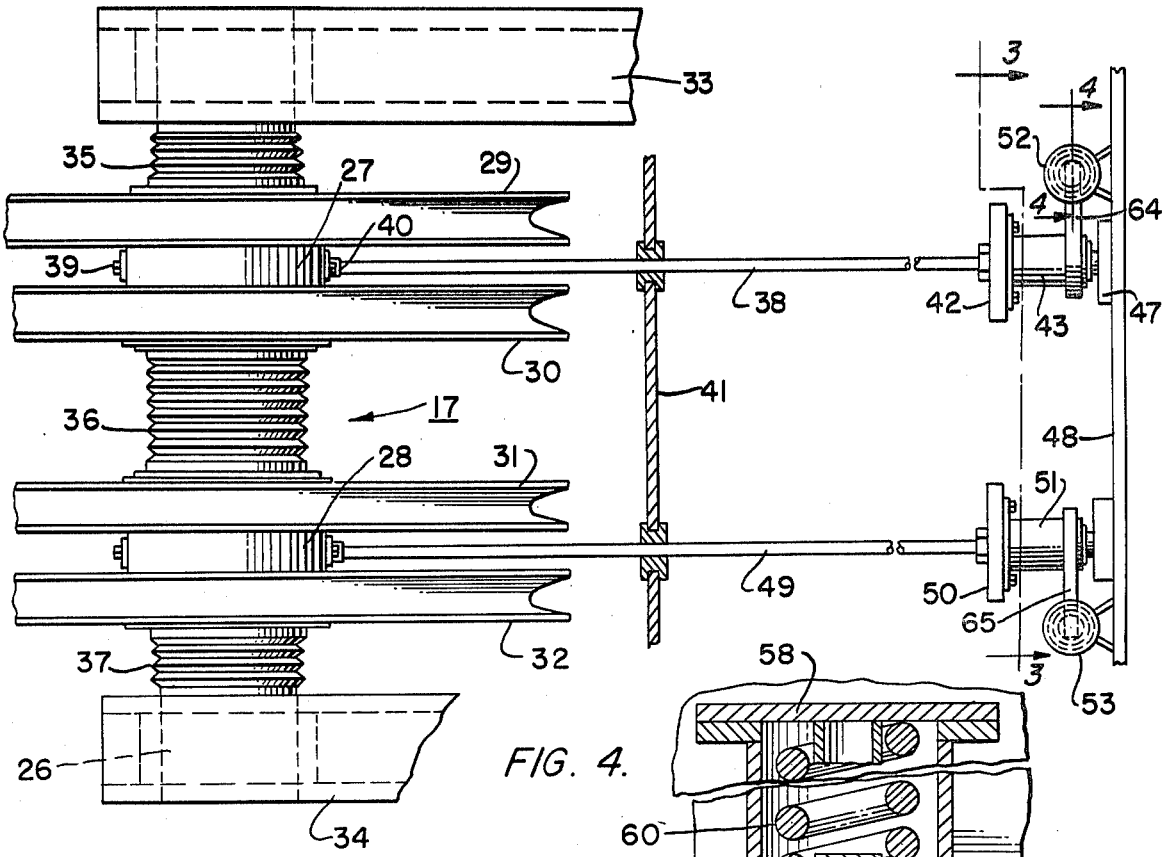
FIG. 2 is an enlarged cross-sectional view taken along line 2—2 in FIG. 1.
Figure 4:
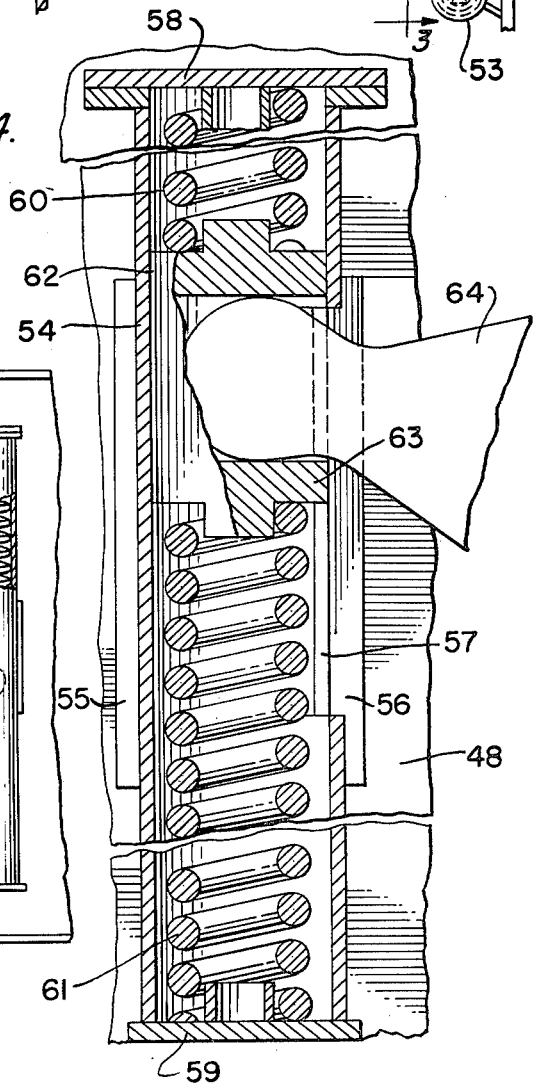
FIG. 4 is an enlarged cross-sectional view taken along line 4—4 in FIG. 2.

Referring to FIG. 1, there is shown a dragline type of excavator 10 which includes a base or tub 11 supported on the ground, a live roller circle assembly 12 supported on the base, and a main frame 13 supported on the live roller circle assembly for swing movement about a vertical axis of the live roller circle assembly. Mounted on the main frame is a gantry structure 14 and the lower end of a boom 15 which is held in suspension by pendants 16 interconnecting the point of the boom and the upper end of gantry structure 14. The point of the boom also is provided with a sheave assembly 17 which embodies the present invention.

Main frame 13 is provided with a housing structure 18 which encloses the lower portion of gantry 14. Also mounted on main frame 13, within housing structure 18, is a hoist rope drum 19 operated by conventional machinery also mounted on the main frame within the housing structure and a drag line drum 20 also operated by conventional machinery mounted on the main frame within the housing structure. A set of hoist ropes 21 are wound on hoist rope drum 19, extend through an opening in the housing structure and over a set of sheaves 22 mounted on the front legs of the gantry structure, extend forwardly and are reeved over and around the sheaves of sheave assembly 17 and extend downwardly to where they are connected to a bucket 23. The bucket is dragged along the surface of the ground being excavated and is manipulated by a drag line 24 which extends over and around a set of fairlead sheaves 25 mounted on the front end of the main frame adjacent the foot of the boom, and is wound on drag line drum 20.

In the operation of the machine shown in FIG. 1, the hoist ropes and drag lines are payed out and taken in in the conventional manner to drag the bucket along the ground to fill it with material being excavated, hoist the bucket to a point adjacent the boom point while the boom is swung to position the bucket over a spoils pile and dump the bucket over the spoils pile. As the boom swings, the hoist ropes reeved around the boom point sheaves apply lateral loads on the boom point sheaves thus necessitating such sheaves be swivably mounted to prevent undue sheave and hoist rope wear.

Boom point sheave assembly 17 generally consists of a support shaft 26, a set of carrier members 27 and 28, a first set of sheaves 29 and 30 and a second set of sheaves 31 and 32. Support shaft 26 is disposed transversely relative to the center line of the boom, having the ends thereof rigidly mounted in longitudinally disposed, side frame sections 33 and 34 of boom 15. The support shaft is provided with a pair of transversely spaced ball-shaped portions on which carrier members 27 and 28 are mounted for swivel movement about axes disposed perpendicular to the transverse axis of the support shaft and substantially parallel to the longitudinal center line of the boom. Carrier member 27 is provided with a pair of transversely spaced bearings on which sheaves 29 and 30 are mounted for rotation about a transverse axis perpendicular to the swivel axis thereof. Similarly, carrier member 28 is provided with a pair of transversely spaced bearings on which sheaves 31 and 32 are mounted for rotation about an axis perpendicular to the swivel axis thereof. Although the support shaft of the assembly and the interior portions of carrier members 27 and 28 are hidden from view by the carrier members and flexible boots 35, 36 and 37, it will be understood that the details of such components are illustrated and described in U.S. Pat. No. 3,757,959.

Carrier member 27 and the ball portion of support shaft 26 on which carrier member 27 is mounted are provided with aligned openings along the swivel axis of carrier member 27 through which there is received the front end of a longitudinally disposed rod 38. The front end of rod 38 extends through the opening in the ball portion of the support shaft and is rigidly secured to carrier member 27 by means of threaded nuts 39 and 40 so that carrier member 27 and sheaves 29 and 30, along with rod 38, will be free to swivel about the swivel axis of carrier member 27.

Figure 5:
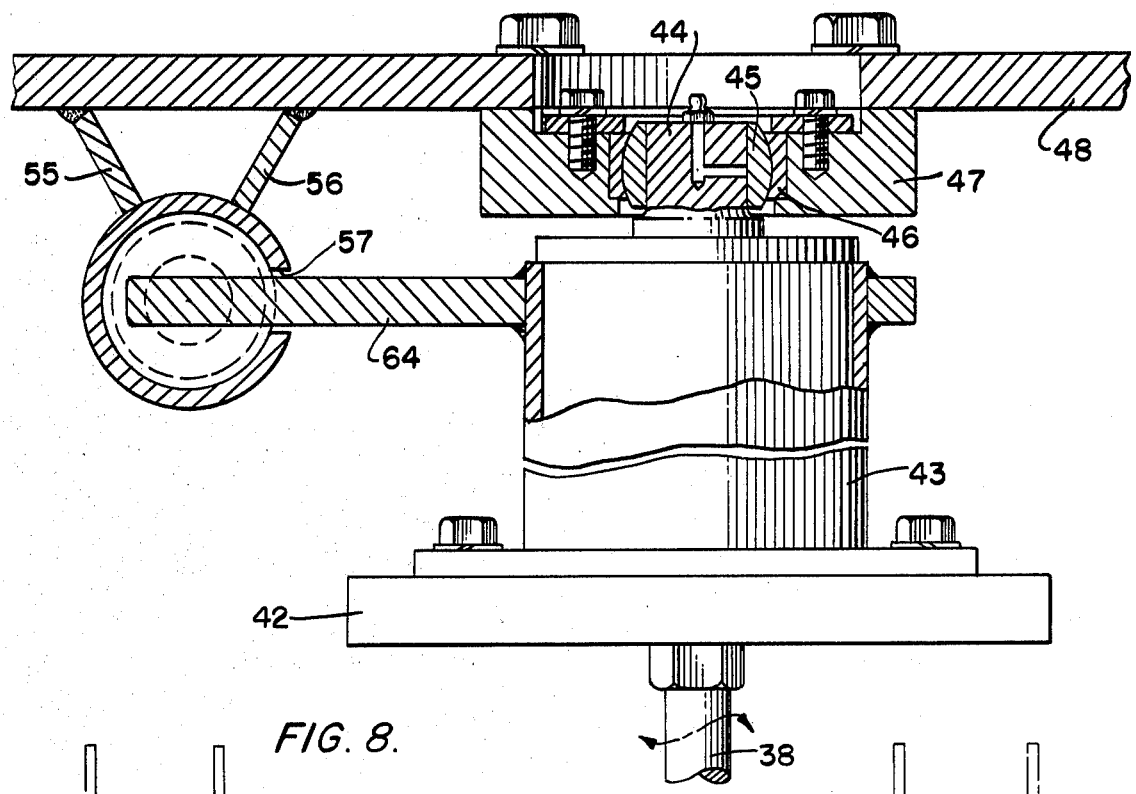
FIG. 5 is an enlarged cross-sectional view taken along line 5—5 in FIG. 3.

The intermediate portion of rod 38 is supported in a transverse section or bulkhead 41 interconnecting side frame sections 33 and 34 of the boom. The rear end portion of rod 38 is provided with a mounting plate 42 on which there is rigidly secured a cylindrical mounting member 43. As best illustrated in FIG. 5, cylindrical mounting member 43 is provided with an axially projecting section 44 having a spherical bearing portion 45. The spherical bearing portion is seated in a solid bearing seat 46 carried on a support plate 47 mounted on a transversely disposed section or bulkhead 48 interconnecting the side frame sections of the boom. Carrier member 28 similarly is provided with a rod 49 disposed along the swivel axis of carrier member 28, secured at its front end to carrier member 28, supported along its intermediate portion in bulkhead 41 and provided at its rear end with a mounting plate 50 and a cylindrical mounting member 51 having an axially projecting section with a spherical bearing seated in a solid bearing seat supported on bulkhead 48. It will be appreciated in the assembly as described that each of the sets of sheaves is capable of swiveling about its own swivel axis independent of the other set of sheaves although, under most operating conditions, the sheaves will be disposed substantially parallel.

Figure 3:
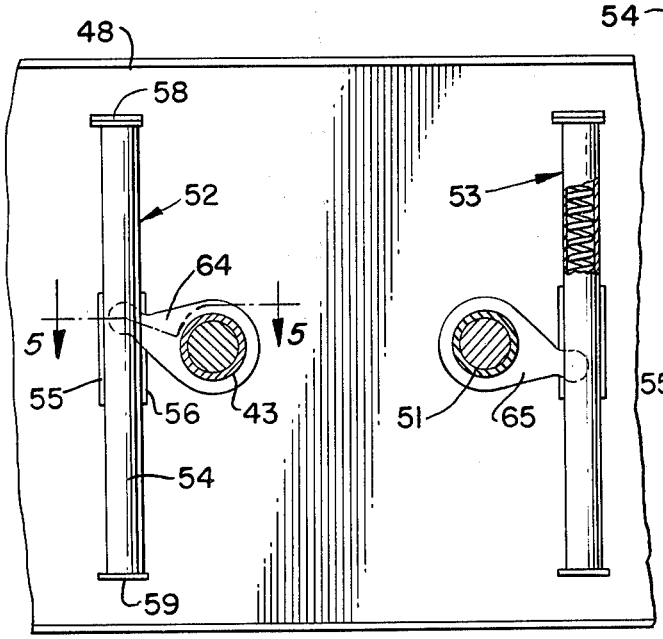
FIG. 3 is a cross-sectional view taken along line 3—3 in FIG. 2.

As best illustrated in FIG. 3, a set of substantially similar spring housings 52 and 53 are mounted on bulkhead 48 adjacent cylindrical mounting members 43 and 51. Housing 52 consists of a cylindrical section 54 mounted on the front side of bulkhead 48 by means of a pair of brackets 55 and 56, having a longitudinally disposed slot 57 on the inner side thereof, and a pair of end walls 58 and 59. A set of coil springs 60 and 61 are disposed within the housing. Coil spring 60 is seated on end wall 58 and coil spring 61 is seated on end wall 59. Interposed between springs 60 and 61 is a floating piston 62 having a side opening socket 63 communicating with slot 57 in the cylindrical section of housing 52.

Cylindrical mounting member 43 is provided with a righting or crank arm 64 which is disposed radially relative to the swivel axis of sheaves 29 and 30. The outer end of arm 64 extends through longitudinal slot 57 in the spring housing and has a curved end portion which is received within socket 63 of floating piston 62. It thus will be seen that whenever the hoist ropes reeved over and around sheaves 29 and 30, impose a lateral load on sheaves 29 and 30, causing them to swivel on the ball portion of the support shaft, such swivel motion will be transmitted through rod 38 and cylindrical mounting member 43 to righting arm 64. Such swivel action will pivot or rotate righting arm 64 thus compressing one of springs 60 and 61 and causing the other of such springs to expand. Upon removal of the lateral load imposed by the hoist ropes on the sheaves, the compressed spring will function to pivot or rotate the righting arm in the opposite direction about the swivel axis of the sheaves to bias or return the sheaves to a predetermined rest position, presumably in vertical planes, thus positioning the sheaves in desired attitudes which will minimize the wear on both the sheaves and the hoist ropes.

Housing 53 similarly contains a set of coil springs acting on righting arm 65 to bias or return sheaves 31 and 32 to predetermined rest positions as described in connection with sheaves 29 and 30.

Figure 6:
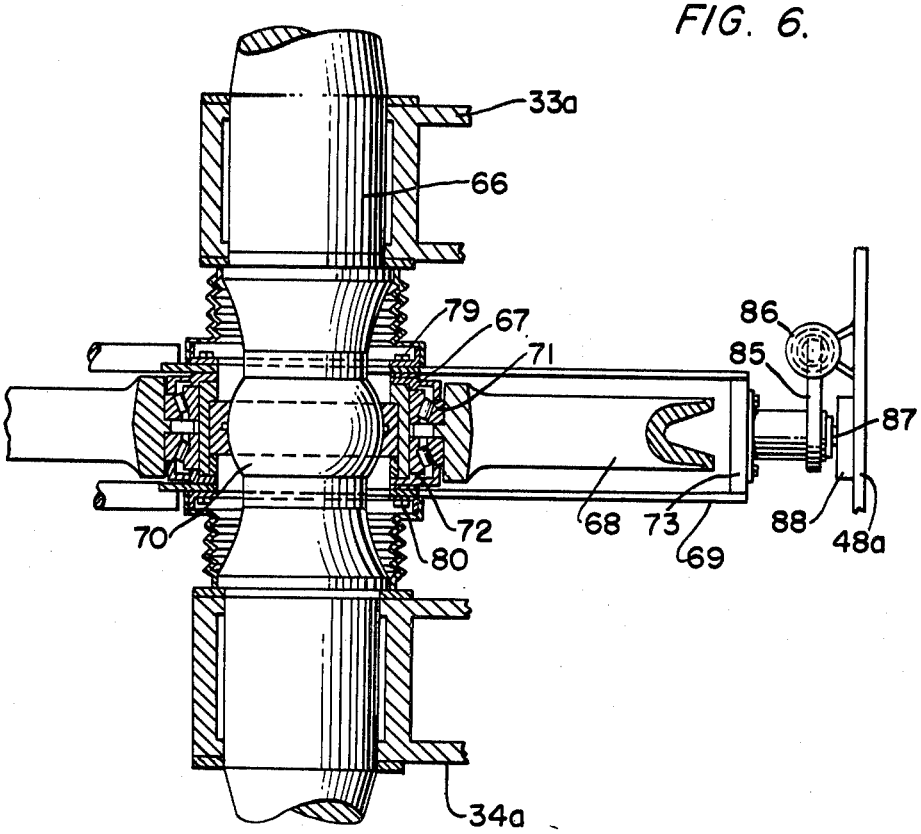
FIG. 6 is a top plan view of another boom point sheave assembly incorporating another embodiment of the present invention.
Figure 7:
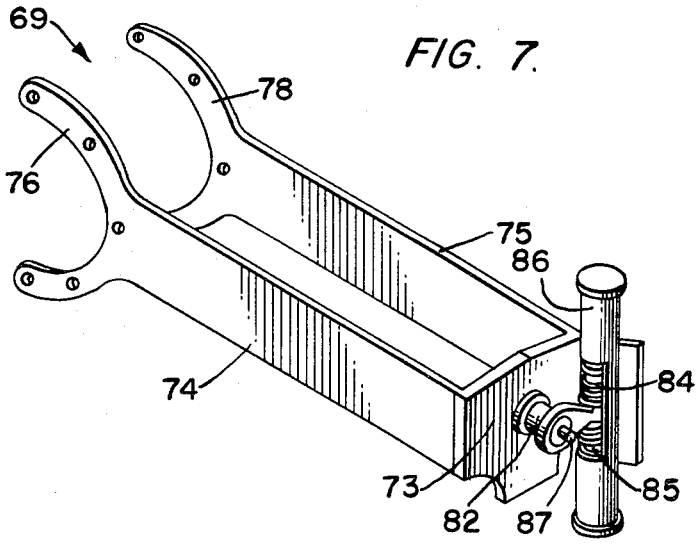
FIG. 7 is a partially exploded, perspective view of the embodiment of the invention shown in FIG. 6.

Referring to FIGS. 6 and 7, there is illustrated another boom point sheave assembly embodying the present invention. The assembly generally includes a support shaft 66, a carrier member 67, a sheave 68 and a connecting bracket 69. Support shaft 66 is supported at its ends in side frame sections **33*a* and 34*a* of a boom and is provided with a ball or spherical-shaped intermediate portion 70. Carrier member 67 is mounted on ball portion 70 and is adapted to swivel relative to the support shaft about a swivel axis disposed perpendicular to the transverse axis of the support shaft. The carrier member is provided with sets of bearings 71 and 72 on which sheave 68** is mounted for rotation about an axis disposed perpendicular to the swivel axis.

Connecting bracket 69 has a substantially U-shaped configuration including a web section 73 spaced rearwardly from sheave 28 and a pair of leg sections 74 and 75 spaced laterally from sheave 68, having forwardly disposed arcuate portions 76 and 78 which are rigidly secured to the carrier member by means of sets of bolts 79 and 80. Essentially, connecting bracket 69 straddles the rearwardly disposed side of sheave 68 and is rigidly secured to the carrier member so that the carrier member, sheave and connecting bracket swivel together as a unit. The biasing or return assembly used with the sheave assembly shown in FIGS. 6 and 7 is substantially identical to the assembly described in connection with the embodiment shown in FIGS. 2 through 5. It includes a bracket on which a cylindrical mounting member 82 is provided. Mounting member 82 is provided with a righting or crank arm 85 comparable to righting or crank arm 64 described in connection with the embodiment shown in FIGS. 2 through 5, which is engaged by a set of coil springs 84 and 85 contained in a spring housing 86. Mounting member 82 further is provided with an axially disposed section 87 provided with a spherical bearing seated in a bearing block provided on a mounting plate 88. As best seen in FIG. 6, spring housing 86 and mounting plate 88 are rigidly secured to a bulkhead 48*a* of the boom.

In the operation of the embodiment shown in FIGS. 6 and 7, whenever the hoist rope reeved over and around sheave 68 imposes a lateral load on the sheave, causing it to swivel, such swivel motion will be transmitted through connecting bracket 69 and mounting member 82 to pivot or rotate righting arm 85. The pivotal action of arm 85 will cause one of springs 84 and 85 to compress while causing the other spring to expand. Upon removal of the lateral load on sheave 68, the compressed spring will act on the righting arm to bias or return sheave 68 to its predetermined rest position.

Figure 8:
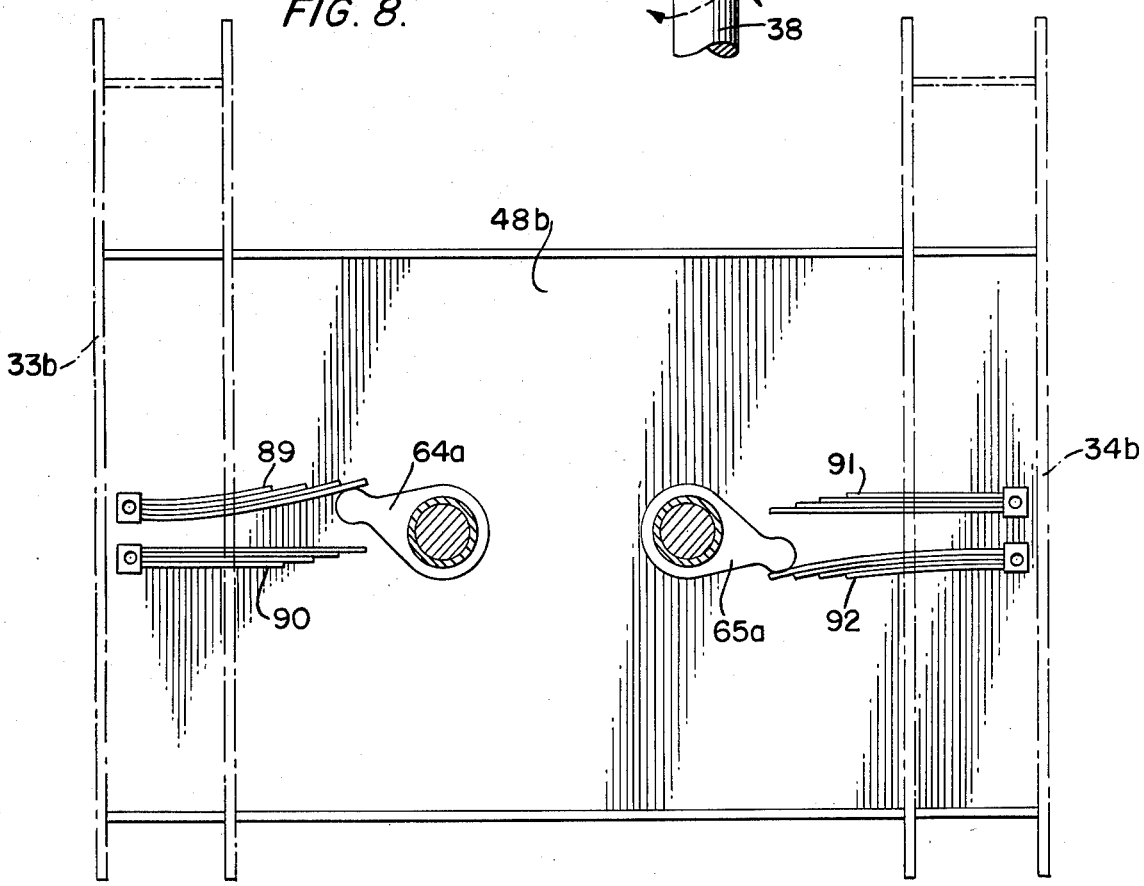
FIG. 8 is a view similar to the view shown in FIG. 3, illustrating a modification of the embodiment of the invention shown in FIGS. 2 through 5.

FIG. 8 illustrates a modification of the embodiment shown in FIGS. 2 through 5. The modification consists of using sets of leaf springs 89 and 90, and 90 and 91, in lieu of coil springs, which are engaged by the free ends of righting arms 64*a* and 65*a* for pivoting or rotating the righting arms and thus biasing or returning sheaves 29 through 32 to their predetermined rest positions. The sets of leaf springs are rigidly mounted on bulkhead 48*b* interconnecting the side frame sections 33*b* and 34*b* of the boom. This modification provides simply a different form of biasing means for pivoting or rotating the righting arms of the assemblies for biasing or returning the sheaves to their predetermined rest positions.

The components of the various embodiments of the invention as hereinbefore described are simple in configuration and can be easily purchased or fabricated. Such components also can be easily mounted on the point of a boom with minimal time and effort. Furthermore, because of the simplicity in design and function, such assemblies for biasing or returning the sheaves to their predetermined rest positions will have a prolonged service life requiring minimal, if any, maintenance effort.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. In a machine having a boom, a sheave rotatably mounted on said boom, means for swivably mounting said sheave on said boom for pivotal motion about a swivel axis and a line reeved over and around said sheave, an assembly for returning said sheave to a predetermined position relative to said boom upon said sheave being pivotally displaced about its swivel axis by forces applied by said line, comprising:

a righting arm, connecting rod means operatively connecting said sheave to said righting arm for transmitting said pivotal motion of said sheave about said swivel axis to said righting arm and means operatively engageable with said righting arm for pivotally biasing said righting arm and correspondingly said sheave about said swivel axis toward said predetermined position.

2. An assembly according to claim 1 wherein said biasing means comprises at least one coil spring.

3. An assembly according to claim 1 wherein said biasing means comprises a set of coil springs mounted on said boom and means for engaging said coil springs with opposite sides of said righting arm.

4. An assembly according to claim 1 wherein said biasing means comprises leaf springs.

5. An assembly according to claim 1 wherein said biasing means comprises a set of leaf springs mounted on said boom and engaging opposite sides of said righting arm.

6. An assembly according to claim 1 including a transversely disposed shaft mounted on said boom, carrier means swivably mounted on said shaft, said sheave being rotatably mounted on said carrier means, and a said connecting rod mounted on said carrier means and disposed along said swivel axis and wherein said righting arm is mounted on said connecting rod and is disposed radially relative to said swivel axis.

7. An assembly according to claim 6 wherein said biasing means comprises at least one coil spring.

8. An assembly according to claim 6 wherein said biasing means comprises a set of coil springs mounted on said boom and means for engaging opposite sides of said righting arm.

9. An assembly according to claim 8 including a housing mounted on said boom having a set of end walls and a longitudinally disposed slot, and wherein said coil springs are disposed in said housing, each engaging a housing end wall, and said righting arm is provided with an end portion extending through said slot into said housing and is engaged by said means for engaging to thereby engage opposed ends of said springs.

10. An assembly according to claim 6 wherein said shaft is provided with a ball portion having an opening therethrough, and wherein said carrier means is swivably mounted on said ball portion and said rod is journaled in said boom, has a portion projecting through the opening in said ball portion of said shaft and is connected to said carrier member.

11. An assembly according to claim 10 wherein said biasing means comprises a set of coil springs mounted on said boom and engaging opposite sides of said righting arm.

* * * * *